US005813145A

United States Patent [19]

Prober

[11] Patent Number: 5,813,145

[45] Date of Patent: Sep. 29, 1998

[54] PERFECT FITTING SHOE AND METHOD OF MANUFACTURING SAME

[76] Inventor: Gregory Prober, Flat 4-E, Block 10, Sceheway Garden, Lam Tin, Kowloon, Hong Kong

[21] Appl. No.: 680,646

[22] Filed: Jul. 17, 1996

[51] Int. Cl.[6] ..... A43B 3/26

[52] U.S. Cl. ..... 36/93; 36/97; 36/76 C

[58] Field of Search ..... 36/97, 93, 76 C

[56] References Cited

U.S. PATENT DOCUMENTS

| | | | |
|---|---|---|---|
| 3,404,468 | 10/1968 | Rosen | 36/97 X |
| 3,686,777 | 8/1972 | Rosen | 36/97 |
| 4,553,342 | 11/1985 | Derderian | 36/97 |
| 4,554,749 | 11/1985 | Ostrander | 36/102 |
| 4,944,099 | 7/1990 | Davis | 36/97 |
| 5,123,181 | 6/1992 | Rosen | 36/97 |
| 5,259,126 | 11/1993 | Rosen | 36/93 |

*Primary Examiner*—Ted Kavanaugh

[57] ABSTRACT

The present invention relates to a first perfect fitting shoe (110) comprising: a first upper (114) securely fastened to a sole (12) in all areas except a ball area. The first upper (114) has an inside ball area and outside ball area which are securely fastened to each other by an elastic (16). Thus, the first perfect fitting shoe (110) can be adjusted to the user's foot prior to final lasting of the at innersole (12A) to the outersole (12B) at the ball area.

5 Claims, 1 Drawing Sheet

PERFECT FITTING SHOE AND METHOD OF MANUFACTURING SAME

BACKGROUND OF THE INVENTION

1. Field of the Invention

The present invention relates to shoes an method of manufacturing and fitting. More particularly, the present invention relates to shoes having an upper securely attached at the toe, heal and waist (or shank) lacking attachment at the ball area.

2. Description of the Prior Art

Many people constantly complain that shoes do not fit because they have been made on narrow lasts and do not reflect the fact that over seventy percent (70%) of the people have different sized left and right feet. The present invention describes perfect fitting shoes and a method of making the same. There is a tremendous need for a simple, practical and rapid means of sizing a shoe to a person's foot. The shoe industry is plagued with having to carry numerous shoes in numerous sizes. By utilizing the present invention a retail store is able to carry a larger number of shoe styles and sizes but only one or two adjustable width sizes which reduces overall inventory cost.

Numerous innovations for shoes have been provided in the prior art that are described as follows. Even though these innovations may be suitable for the specific individual purposes to which they address, they differ from the present invention as hereinafter contrasted.

In U.S. Pat. No. 4,554,749, titled Slipper, invented by Charles Ostrander, a slipper including an upper defining a cover for substantially encompassing a foot which is formed at least partially of elastomeric material, and a sole divided into discrete, spaced fore and aft sections secured to a base portion of the cover.

The patented invention differs from the present invention because the patented invention is a construction method leading to a finished shoe at the point of manufacture. The present invention comprises a method and a means of adjusting the width of shoes for a customer while he waits.

In U.S. Pat. No. 4,944,099, titled Expandable Outsole, invented by Howard Davis, an improved shoe outsole having an elastic shank and suitable for outdoor wear, outsole portions comprises of semi-rigid material for forming same, and a shoe incorporating the improved the improved outsole are disclosed. The front outsole portion has a ledge extending width wise across the back end thereof and the rear outside portion has a ledge extending width wise across the front end thereof such that the elastic shank is joinable to the outsole portions by means extending through the shank and the ledge.

The patented invention differs from the present invention because the patented invention is an improvement of a sole. It is not a end point adjustment of the width of the shoe. It is intended that the advantages of the patented invention are realized during manufacturer and use not at the time of sale. The present invention comprises a method and a means of adjusting the width of shoes for a customer while he waits.

In U.S. Pat. No. 5,123,181, titled Adjustable Girth Shoe Construction, invented by Henry E. Rosen an improved shoe construction is disclosed which affords manually operable girth adjustment by a shoe upper having a width wise adjustable bottom section and substantially hidden girth adjusting removably attachable fastener positioned between the bottom section of shoe upper and the sole.

The patented invention differs from the present invention because the patented invention is a temporary adjustment designed to be adjusted by the user. The present invention is adjustable but is fixed at the point of sale to fit the wearer. The present invention is a one time only adjustment.

Numerous innovations for shoes have been provided in the prior art that are adapted to be used. Even though these innovations may be suitable for the specific individual purposes to which they address, they would not be suitable for the purposes of the present invention as heretofore described.

SUMMARY OF THE INVENTION

The present invention describes perfect fitting shoes and a method of making the same. The method is the best way to produce and sell comfortable dressy and street shoes and sandals for women and men through retail shoe stores. The method allows the retailer to furnish the customer with a perfect fitting shoe in approximately one hour. In contrast, only a very few stores carry a limited variety of styles in wide and narrow widths which still cannot fit perfectly to persons having feet deformities. Orthopedic and custom made shoes have limited fashion choice, long time to produce and high retail prices.

The types of problems encountered in the prior art are the majority of person's have different sized feet requiring a retail store to stock in inventory numerous styles, colors, sizes and width of shoe, and still not being able to satisfy many people whose feet would not fit to the existing lasts measurements.

In the prior art, unsuccessful attempts to solve this problem were attempted namely: utilizing uppers with stretchable means therebetween. However, the problem was solved by the present invention because the material was securely attached to the upper at each side of the ball area and securely attached at the toe and shank area as well as the stretch material securely attached to the insole.

Innovations within the prior art are rapidly being exploited in the field of shoe manufacturing.

The present invention went contrary to the teaching of the art which taught stretchable material attached solely to the upper which increased the time required to make adjustment and corresponding markings.

The present invention solved a long felt need to have an adjustable shoe and method of manufacturing the shoe which a retailer could simply, practically and rapidly utilize in a retail store.

The present invention produced unexpected results namely: persons with deformities were also easily fit into wide range of shoes.

A synergistic effect was produced utilizing the present invention due to the following facts and results from experimentation: proper fitted shoes functioned as orthopedic shoes giving the user better balance and more comfortable wearing.

Accordingly, it is an object of the present invention to provide a perfect fitting shoe.

More particularly, it is an object of the present invention to provide a perfect fitting shoe having an elastic and a nylon tape stitched between the inside and outside of the lasting allowances of the uppers in the ball and toe areas. Nylon tape allows the upper to be fully stretched during pulling.

In keeping with these objects, and with others which will become apparent hereinafter, one feature of the present invention resides, briefly stated, in a first perfect fitting shoe having a first upper attached at a first upper toe and a first upper back to the bottom.

When the second perfect fitting shoe is designed in accordance with the present invention, a second upper consists of a second upper back strap securely fastened to a sole and a second upper front strap and at least one second upper middle strap adjustably mounted to the sole.

In accordance with another feature of the present invention, the sole comprises a sole insole and a sole outsole.

Another feature of the present invention is that the sole insole comprises a sole insole front, sole insole back, sole insole left side, sole insole right side, sole insole top surface, sole insole bottom surface, sole insole ball area, sole insole toe piece, and sole insole shankboard.

Yet another feature of the present invention is that the sole outsole comprises a sole outsole front, sole outsole back, sole outsole left side, sole outsole right side, sole outsole top surface, sole outsole bottom surface, and sole outsole ball area.

Still another feature of the present invention is that the upper is securely fastened to the sole insole toe piece during front lasting.

Yet still another feature of the present invention is that the upper is securely fastened to the sole insole shankboard during back port lasting.

Still yet another feature of the present invention is that the upper is securely fastened at an inside and outside of a ball area to an elastic having a tape securely fastened therebetween.

Another feature of the present invention is that the elastic is securely attached to the sole insole shankboard and the sole insole toe piece allowing the ball area of the upper, which is non-attached to the outersole, to widen and narrow when placed on a person's foot.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

COMPONENTS

12—sole (12)
12A—innersole (12A)
12AA—innersole front (12AA)
12AB—innersole back (12AB)
12AC—innersole left side (12AC)
12AD—innersole right side (12AD)
12AE—innersole top surface (12AE) (not shown)
12AF—innersole bottom surface (12AF)
12AG—innersole ball area (12AG)
12AH—innersole toe piece (12AH)
12AI—innersole shankboard (12AI)
12AJ—innersole lasting (12AJ)
12AJA—innersole front lasting ( 12AJA)
12B—sole outsole (12B)
12BA—sole outsole front (12BA)
12BB—sole outsole back (12BB)
12BC—sole outsole left side (12BC)
12BD—sole outsole right side (12BD)
12BE—sole outsole top surface (12BE)
12BF—sole outsole bottom surface (12BF)
12BG—sole outsole ball area (12BG)
16—elastic (16)
18—tape (18)
20—socklining (20) (not shown)
20A—socklining pad (20A) (not shown)
20AA—socklining pad center (20AA) (not shown)
22—device (22) (not shown)

FIRST EMBODIMENT

110—first perfect fitting shoe (110)
114—first upper (114)
114A—first upper toe (114A)
114B—first upper back (114B)

DESCRIPTION OF THE PREFERRED EMBODIMENT

Figure 1:
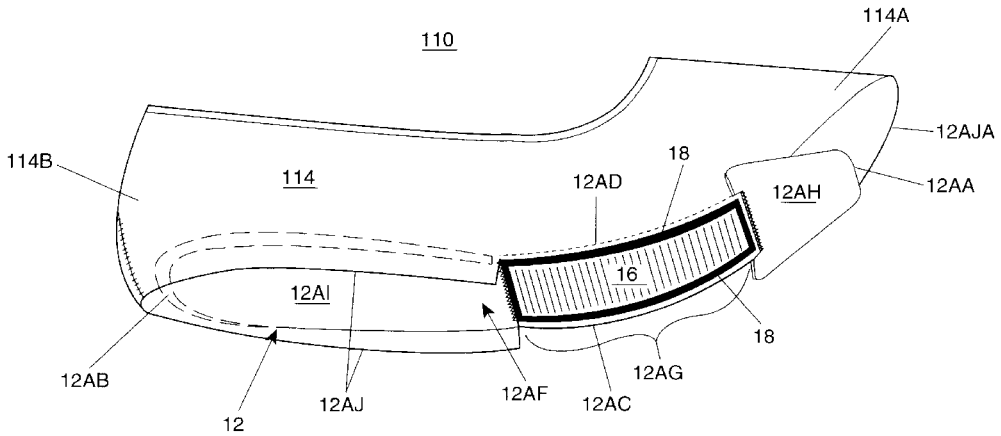
FIG. 1 is a left bottom perspective view of a first perfect fitting upper stitched to the innersole.

Firstly, referring to FIG. 1 which is a left bottom perspective view of a first perfect fitting shoe (110). The first upper (114) is wrapped circumferentially around the innersole (12A). The elastic (16) is securely fastened to an inside and outside edge of the first upper (114) at a ball area. The elastic (16) has a tape (18) therebetween. The elastic (16) is further securely attached to a front edge of an innersole shankboard (12AI) and a rear edge of a innersole toe piece (12AH). The elastic (16) functions to allow stretchability of the first upper (114) at the ball area prior to permanent outersole ball attachment in store. The innersole (12A) consists of an innersole front (12AA), innersole back (12AB), innersole left side (12AC), innersole right side (12AD), innersole top surface (12AE) (not shown), innersole bottom surface (12AF), and a innersole ball area (12AG).

Figure 1A:
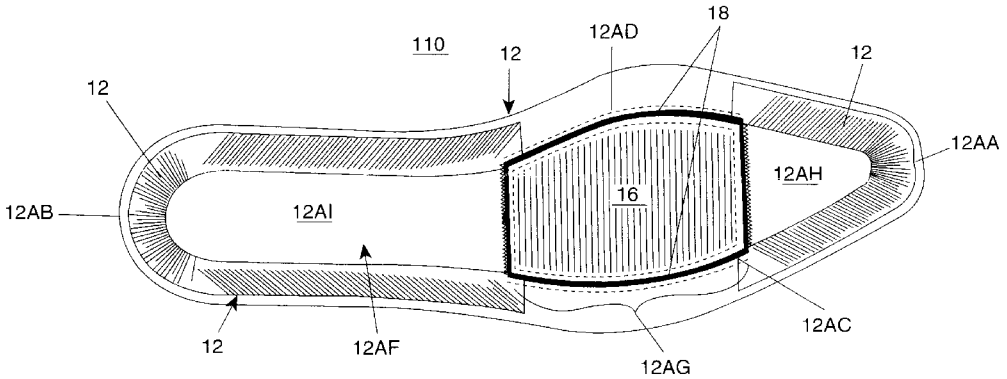
FIG. 1A is a bottom view of a first perfect fitting shoe after the upper lasting, ruffing, and gluing.

Referring to FIG. 1A is a bottom view of a first perfect fitting shoe (110). A first upper back (114B) of a first upper (114) is lasted (securely fixed) to the innersole shankboard (12AI). A first upper toe (114A) of the first upper (114) is lasted (securely fixed) to the innersole toe piece (12AH) thereby forming a innersole front lasting (12AJA). The elastic (16) functions to allow stretchability of the first upper (114) at the ball area prior to permanent outersole ball attachment.

Figure 1B:
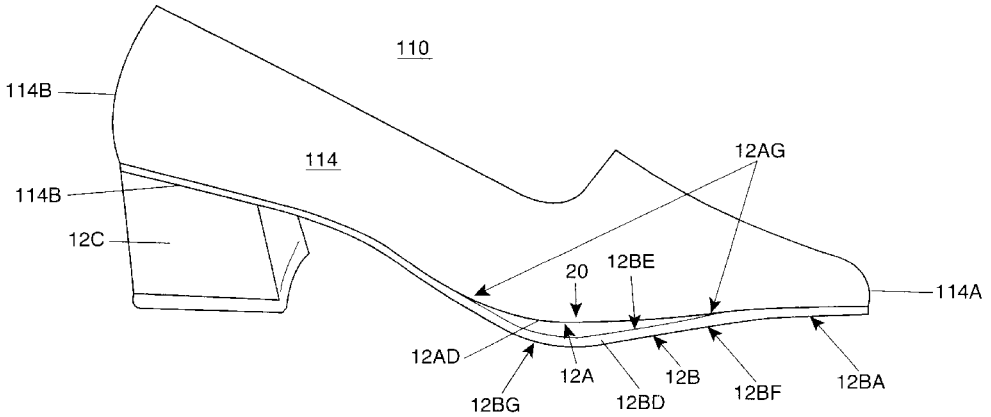
FIG. 1B is a left side view of a first perfect fitting shoe after the outersole and the heel attachment.

Now referring to FIG. 1B which is a left side view of a first perfect fitting shoe (110). A sole outsole (12B) comprises a sole outsole front (12BA), sole outsole back (12BB), sole outsole left side (12BC), sole outsole right side (12BD), sole outsole top surface (12BE), sole outsole bottom surface (12BF), and a sole outsole ball area (12BG). The innersole (12A) and the upper are securely fastened to the outersole (12B) in all areas except the innersole ball area (12AG), thereby premitting adjustability. A heel (12K) may be optionally securely mounted the bottom surface (12BF) at a back (12BB) of the outersole (12B). A socklining (20) having a socklining pad (20A) (not shown) and a socklining pad center (20AA) (not shown) is optionally mounted within the first perfect fitting shoe (110).

After a person selects the first perfect fitting shoe (110) and places it on one foot, the elastic (16) stretches and a salesperson marks the first upper (114) near the outersole edges in ball areas corresponding to the person's foot width. The person then places the other first perfect fitting shoe (110) on the other foot, the elastic (16) stretches and a salesperson marks the first upper (114) corresponding to the person's other foot width. The salesperson then removes both first perfect fitting shoes (110) and places each on a device (22) which will be adjusted to correspond to the size of the markings of each person's feet, ruffs off lasting allowances of the upper in the ball area, glue them on, let them dry and then securely fastens the first upper (114) to the outersole (12B) at the ball area (12AG). The first perfect fitting shoe (110) can be manufactured from a material selected from a group consisting of leather, leather composite, plastic, plastic composite, rubber, rubber composite, natural fibers and synthetic fibers.

It will be understood that each of the elements described above, or two or more together, may also find a useful application in other types of constructions differing from the type described above.

While the invention has been illustrated and described as embodied in a shoe, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A fitting shoe (110) comprising:

A) a first upper (114) which comprises a first upper toe (114A) and a first upper back (114B);

B) a sole 12) which comprises:

i) an innersole (12A) which comprises an innersole front (12AA), an innersole back (12AB), an innersole left side (12AC), an innersole right side (12AD), an innersole top surface (12AE), an innersole bottom surface (12AF), an innersole ball area (12AG), an innersole toe piece (12AH), an innersole shankboard (12AI), the first upper toe (114A) is securely fastened to the innersole toe piece (12AH) forming an innersole front lasting (12AJA)), the first upper back (114B) is securely fastened to the innersole shankboard (12AI), and ii) an outersole (12B) which comprises a outersole front (12BA) which is securely fastened to the innersole and upper front (12AA), an outersole back (12BB) which is securely fastened to the innersole and upper back (12AB), an outersole left side (12BC) which is securely fastened to the innersole left side (12AC), an outersole right side (12BD) which is securely fastened to the innersole right side (12AD), an outersole top surface (12BE) which is securely fastened to the innersole and upper bottom surface (12AF), an outersole bottom surface (12BF), and an outersole ball area (12BG); and C) an elastic (16) and a tape (18) which is securely fastened to an inside and outside of an unfastened portion of the first upper (114) and securely fastened to a front edge of the innersole shankboard (12AI) and securely fastened to a rear edge of an innersole front (12AH) whereby the elastic and tape function to allow stretchability of the first upper at the ball area of a wearer to allow the shoe to be adjustable and then fixed at the point of sale to fit the wearer.

2. The fitting shoe (110) as described in claim 1, wherein the elastic (16) is securely fastened, having the tape (18) therebetween, to the inside and outside of the unfastened portion of the first upper (114) and securely fastened to the front edge of the innersole shankboard (12AI) and securely fastened to the rear edge of the innersole toe piece (12AH).

3. The fitting shoe (110) as described in claim 1, wherein the outersole (12B) has a sole heel (12K) securely fastened to the outersole bottom surface (12BF) at the outersole back (12BB).

4. The fitting shoe (110) as described in claim 1 further comprises a socklining (20) securely fastened therein, the socklining (20) consists of a socklining pad (20A) having a socklining and a pad center (20AA).

5. The fitting shoe (110) as described in claim 1 is manufactured from a material selected from a group consisting of leather, leather composites, plastic, plastic composites, rubber, rubber composites, natural fibers, and synthetic fibers.

* * * * *